US006105528A

United States Patent [19]

Kuroi et al.

[11] Patent Number: 6,105,528

[45] Date of Patent: Aug. 22, 2000

[54] STEERING HANDLE APPARATUS FOR WATERCRAFT

[75] Inventors: Shigeru Kuroi, Yokohama; Takaaki Madachi, Hamamatsu, both of Japan

[73] Assignees: NHK Morse Co., Ltd., Yokohama-shi; Yamaha Hatsudoki Kabushiki Kaisha, Shizuoka, both of Japan

[21] Appl. No.: 09/325,830

[22] Filed: Jun. 4, 1999

[30] Foreign Application Priority Data

Jun. 11, 1998 [JP] Japan ..... 10-163629

[51] Int. Cl.[7] ..... B63H 25/08

[52] U.S. Cl. ..... 114/154; 440/40

[58] Field of Search ..... 114/144 R, 154, 114/155, 156, 157, 158, 159, 160, 161; 440/40, 58

[56] References Cited

U.S. PATENT DOCUMENTS 1,055,814 3/1913 Seely ..... 114/154
2,257,613 9/1941 Mannfolk ..... 114/154
4,531,921 7/1985 Teraura et al. ..... 114/154
5,256,090 10/1993 Woolley ..... 440/40

*Primary Examiner*—Stephen Avila
*Attorney, Agent, or Firm*—Frishauf, Holtz, Goodman, Langer & Chick, P.C.

[57] ABSTRACT

A steering handle apparatus for a watercraft provided with a steering shaft comprises a housing attached to the body of the watercraft, a tube member supported on the housing so as to be able to tilt back and forth around a pivot portion and including a gear portion and a guide hole through which the steering shaft is passed, a locking member including a fitting portion movable between a locking position for engagement with the gear portion and an unlocking position for disengagement from the gear portion, and an operating member including a retaining portion for moving the locking member. The operating member is operable between an up position in which the locking member is moved to the unlocking position and a down position in which the locking member is moved to the locking position.

5 Claims, 6 Drawing Sheets

STEERING HANDLE APPARATUS FOR WATERCRAFT

BACKGROUND OF THE INVENTION

The present invention relates to a steering handle apparatus for a watercraft, and more particularly, to a tilt mechanism for a steering shaft.

A steering handle apparatus used in a watercraft (referred to also as a water vehicle) comprises a steering shaft that has a handlebar on its top. An arm is provided on the lower end of the steering shaft, and one end of a steering cable is connected to the arm. The other end of the cable is connected to a water jet nozzle that is attached to the rear part of the body of the watercraft. If the handlebar is moved, the arm is moved corresponding to the moving direction of the handlebar. As this is done, the steering cable is pushed or pulled, whereupon the direction of the nozzle is changed.

Conventionally, there have been proposed one such steering handle apparatus that comprises a tilt mechanism for changing the tilt angle of the steering shaft in some measure, depending on a driver's constitution or preference. This tilt mechanism includes a tiltable member for supporting the steering shaft. The tilt angle of the steering shaft can be adjusted by turning a knob to rotate a screw member that fixes the tiltable member.

When the watercraft is driven, relatively high power input is applied to the handlebar, depending on the wave conditions, steering conditions, etc. Accordingly, the conventional tilt mechanism includes the screw member that is rotated by means of the knob or the like, in order to secure a given strength against load that acts on the handlebar. Therefore, the tilt mechanism requires troublesome operations, such as turning the knob to rotate the screw member in changing the tilt angle. Thus, the tilt angle cannot be adjusted easily and speedily with every change of the driver. Besides, the conventional tilt mechanism is composed of a lot of parts, which entail high costs.

BRIEF SUMMARY OF THE INVENTION

Accordingly, the object of the present invention is to provide a steering handle apparatus for a watercraft, capable of quickly adjusting the tilt angle by simple operation and having satisfactory strength against load that acts on a handlebar.

In order to achieve the above object, a steering handle apparatus according to the present invention comprises: a housing attached to the body of a watercraft and including supporting means on either side thereof; a tube member including a pivot portion supported on the housing by the supporting means, having a vertical guide hole through which a steering shaft is passed, capable of tilting back and forth around the pivot portion, and including a gear portion formed of a plurality of teeth arranged along a circular arc around the pivot portion; a locking member attached to the housing and including a fitting portion movable between a locking position in which the fitting portion engages those teeth of the gear portion which are situated corresponding to the tilt angle of the tube member and an unlocking position in which the fitting portion is disengaged from the gear portion; and an operating member including a retaining portion capable of engaging the locking member, the operating member being operable between a down position in which the locking member is moved to the locking position and an up position in which the locking member is moved to the unlocking position.

In the steering handle apparatus according to the invention, the retaining portion of the operating member pushes the locking member toward the gear portion when the operating member is in the down position. Thereupon, the fitting portion of the locking member engages the teeth of the gear portion that are situated corresponding to the tilt angle of the steering shaft. In changing the tilt angle of the steering shaft, the locking member is rocked upward by manually pulling up the operating member to the up position. As this is done, the fitting portion is disengaged from the teeth of the gear portion or unlocked. Accordingly, the tube member is allowed to rock back and forth, so that the steering shaft can also rock integrally with the tube member back and forth. If the operating member is lowered to the down position after the steering shaft is adjusted to a desired tilt angle, the locking member is pushed toward the gear portion by the retaining portion of the operating member. As the fitting portion of the locking member engages the teeth of the gear portion, the locking member is kept at the desired tilt angle.

According to the steering handle apparatus of the invention constructed in this manner, the tilt angle can be quickly made ready to be adjusted by only pulling up the operating member to the up position. After the tilt angle adjustment, the locked state can be quickly restored by only returning the operating member to the down position. The locked state can be maintained with substantial strength against load that is applied from the handlebar.

According to the invention, the steering shaft includes an upper shaft portion, a lower shaft portion, and a universal coupling connecting the upper and lower shaft portions for relative tilting motion, the universal coupling being situated corresponding to the pivot portion. With this arrangement, the angle of the lower shaft portion, which is provided with an arm connected with a steering cable, is fixed even when the tilt angle of the upper shaft portion is changed. Thus, the arm and the steering cable move on a fixed plane. Despite its tilt angle adjustment function, therefore, the steering handle apparatus requires only a narrow space around the arm, so that its lower part can be made compact with advantage.

According to the invention, moreover, the locking member includes a cam surface. The cam surface has a configuration such that the retaining portion of the operating member is urged toward the down position or no force is produced to push up the operating member when power input is applied in the direction to disengage the fitting portion from the gear portion. With this arrangement, the cam surface of the locking member urges the operating member toward the down position when the power input is applied in the direction to disengage the fitting portion of the locking member from the gear portion. Thus, the locking member can be kept in the locking position very securely.

According to the invention, furthermore, a push spring for urging the operating member toward the down position is located between the operating member and the housing. When the operating member is returned to the down position after the tilt angle adjustment, the fitting portion of the locking member and the gear portion may be dislocated so that they cannot immediately engage each other. If the steering shaft is only slightly moved, with this arrangement, however, the fitting portion and the gear portion can be caused to engage each other by means of the urging force of the push spring when they are situated corresponding to each other.

According to the invention, moreover, an assistant spring for producing an urging force to cause the steering shaft rock up toward a neutral position or an up position is located between the housing and the tube member. With this arrangement, the assistant spring pushes up the steering shaft toward the neutral or up position when the locking member is in the unlocking position, so that the tilt angle can be easily adjusted with a small force.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 7:
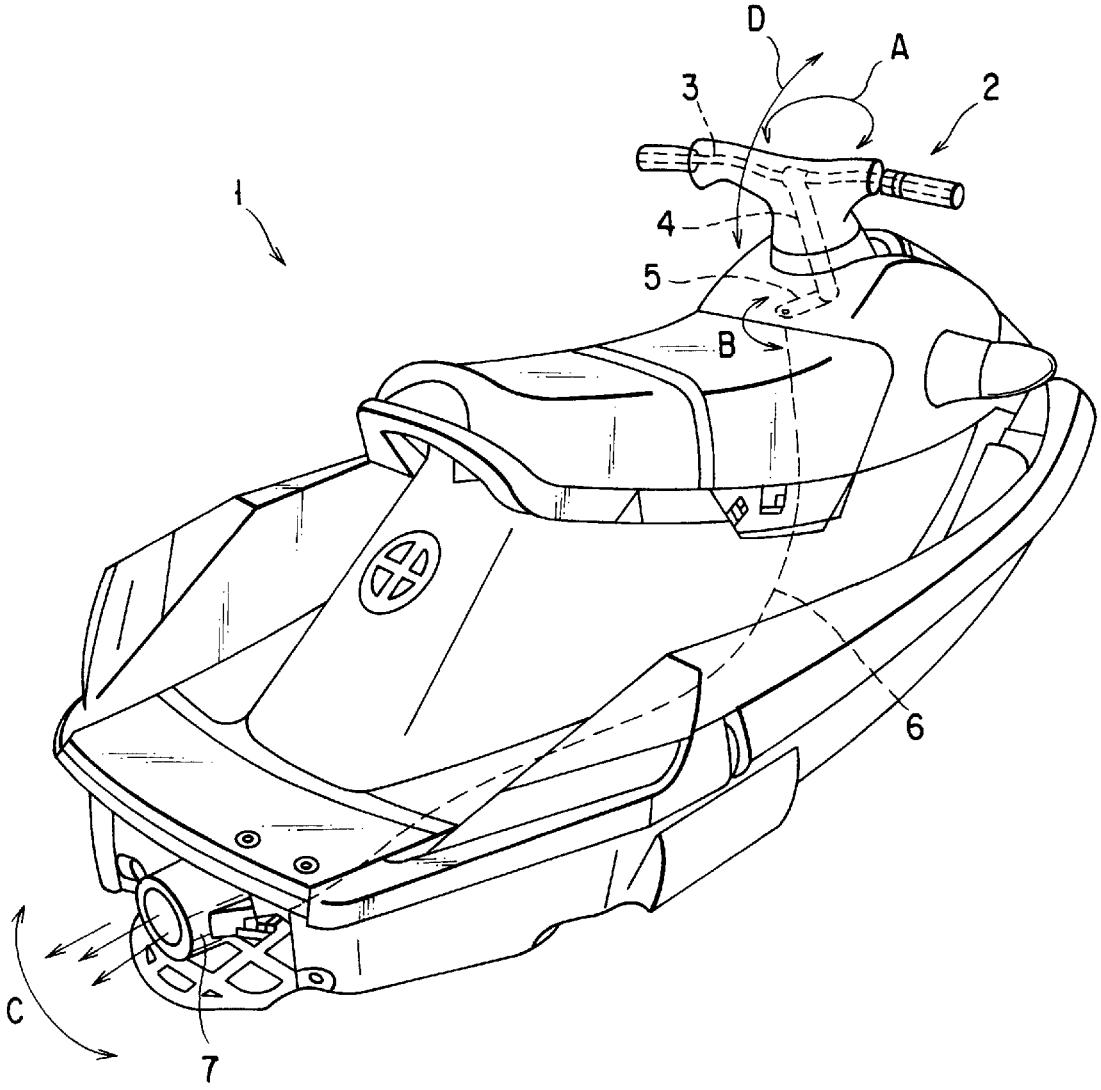
FIG. 7 is a perspective view showing an example of a watercraft.

A steering handle apparatus 2 for a watercraft 1 illustrated in FIG. 7 comprises a steering shaft 4 that has a handlebar 3 on its top. An arm 5 is provided on the lower end of the steering shaft 4, and one end of a steering cable 6, such as a push-pull cable, is connected to the arm 5. The other end of the cable 6 is connected to a water jet nozzle 7 that is attached to the rear part of the body of the watercraft. If the handlebar 3 is rotated in the direction of arrow A in FIG. 7, the arm 5 is rocked in the direction of arrow B corresponding to the direction of the rotation. As this is done, the cable 6 is pushed or pulled, whereupon the nozzle 7 is reoriented in the direction of arrow C.

Figure 1:
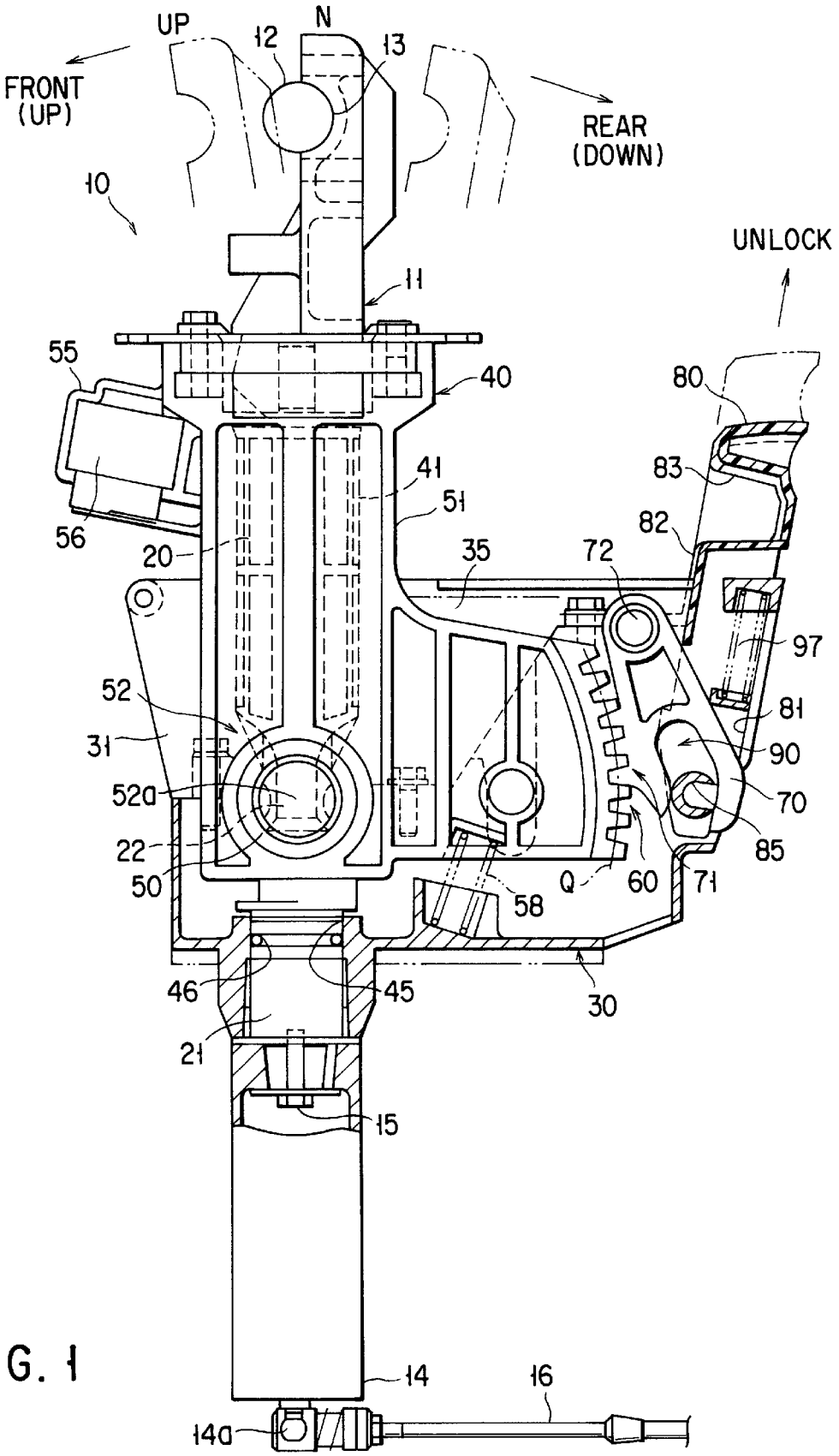
FIG. 1 is a side view, partially in section, showing a steering handle apparatus for a watercraft according to an embodiment of the present invention.
Figure 2:
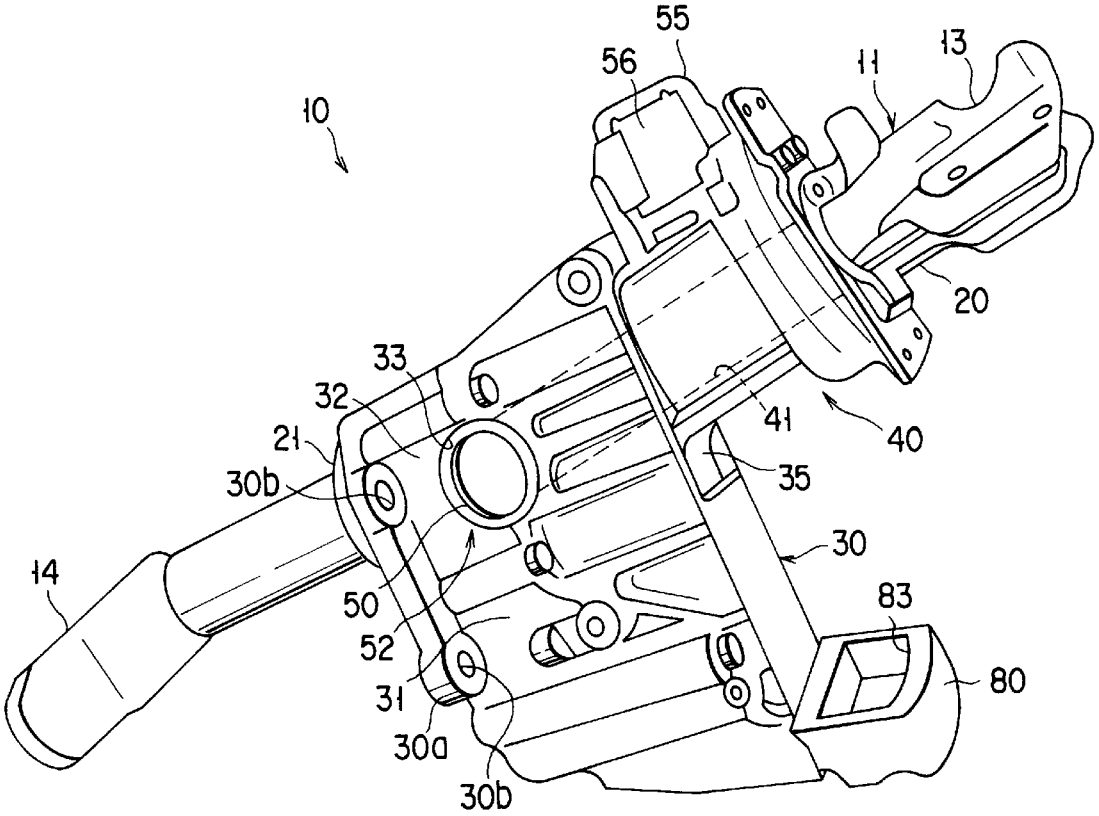
FIG. 2 is a perspective view of the steering handle apparatus shown in FIG. 1.
Figure 3:
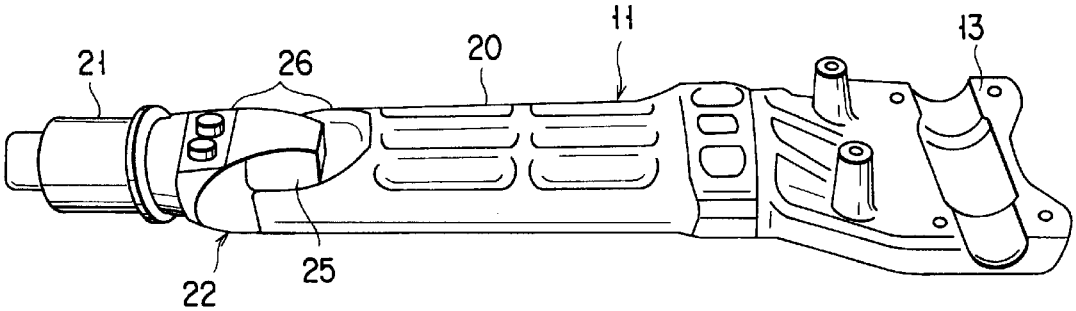
FIG. 3 is a perspective view of a steering shaft used in the steering handle apparatus shown in FIG. 1.
Figure 4:
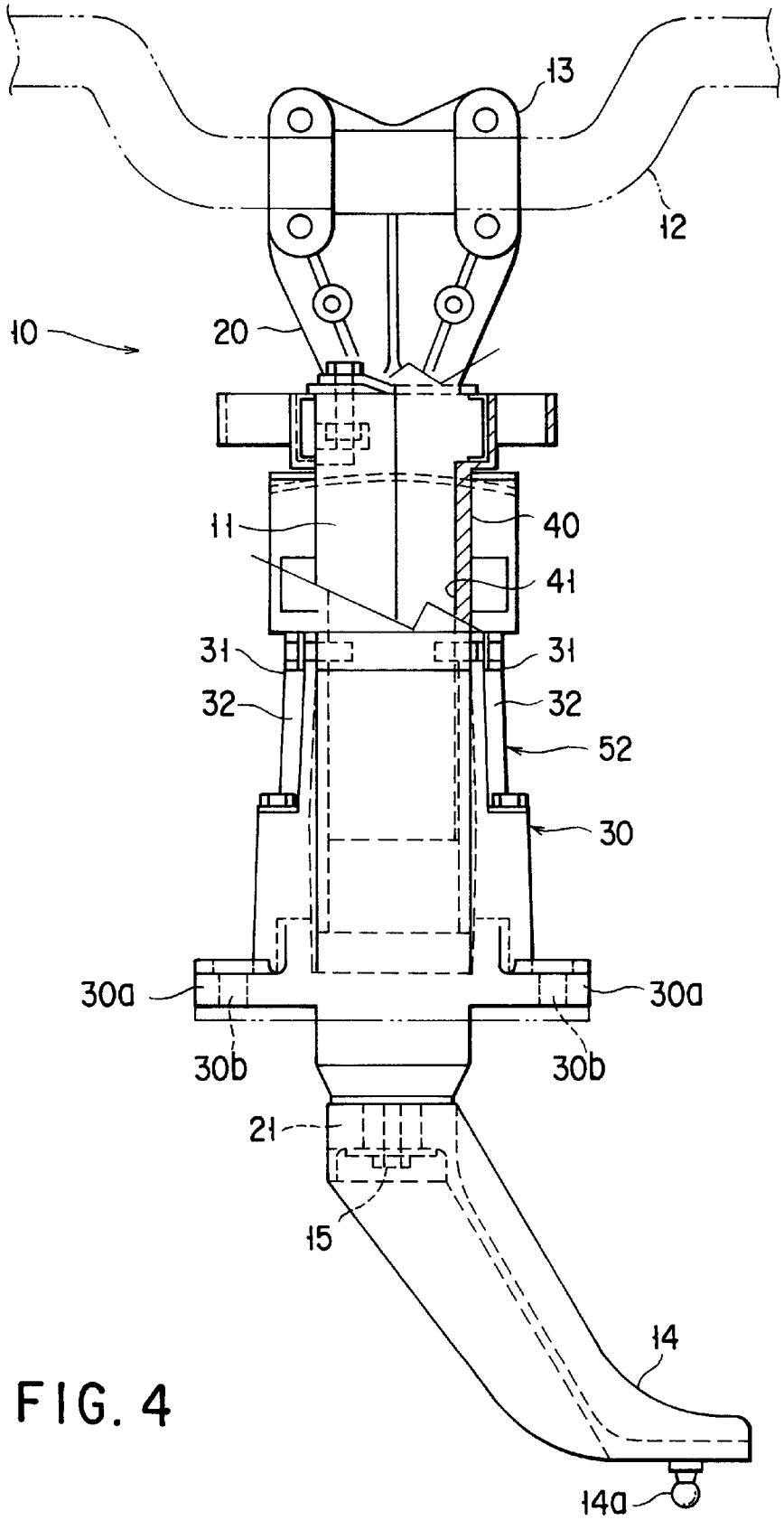
FIG. 4 is a front view, partially in section, showing the steering handle apparatus.

A steering handle apparatus 10 shown in FIGS. 1 and 2 is provided with a steering shaft 11 shown in FIG. 3. A handlebar mounting section 13 for a handlebar 12 (partially shown in FIG. 4), which resembles the conventional one, is provided on the upper part of the shaft 11. The steering shaft 11 is inclined rearward at a tilt angle such that its upper side approaches a driver. An arm 14 is attached to the lower end of the shaft 11 by means of a screw 15 and the like. As shown in FIG. 1, a cable connecting section 14*a* for connecting a steering cable 16, such as a push-pull cable, is provide on the distal end portion of the arm 14.

The steering shaft 11 includes an upper shaft portion 20 constituting the upper side, a lower shaft portion 21 constituting the lower side, and a universal coupling 22 for connecting the upper and lower shaft portions 20 and 21. The coupling 22 is situated on the middle portion of the steering shaft 11 in the axial direction thereof.

The universal coupling 22 is composed of a universal ball 25 and joint members 26 that are rockable with the ball 25 between them. The upper and lower shaft portions 20 and 21 can bent around the coupling 22. A torque can be transmitted between the upper and lower shaft portions 20 and 21 in a bent state.

The steering handle apparatus 10 comprises a housing 30 that is attached to the watercraft body. The housing 30 is formed of, for example, a die-cast light alloy that consists mainly of aluminum, zinc, etc. The housing 30 is fixed to the watercraft body by inserting bolts (not shown) individually into holes 30*b* in a mounting base 30*a* that is formed in a part of the housing.

A boss portion 32 is provided on each of a pair of side wall portions 31, right and left, of the housing 30. Each boss portion 32 is formed having a bearing hole 33, which serves as supporting means. The housing 30 has therein an aperture 35 through which a tube member 40 is inserted into the space between the right- and left-hand side wall portions 31.

The tube member 40 is inserted into the aperture 35 of the housing 30. The member 40 is an integrally molded piece of a synthetic resin, for example. The steering shaft 11 is inserted for rotation around the axis thereof into a guide hole 41 that vertically penetrates the tube member 40.

As shown in FIG. 1, the lower shaft portion 21 of the steering shaft 11 projects downward from the undersurface of the housing 30 through a shaft inlet hole 45 in the lower part of the housing 30. An O-ring 46 for use as a seal member is fitted on that outer peripheral portion of the lower shaft portion 21 which is situated in the inlet hole 45. A waterproof zone is defined in the space below the inlet hole 45 (or inside the watercraft body) that is bordered by the O-ring 46.

Each side wall of the tube member 40 has a shaft 50 in the form of a horizontally extending short cylinder, which is molded integrally with a tube body portion 51. The pair of shafts 50, right and left, are rotatably inserted in their corresponding bearing holes 33 or supporting means of the housing 30, thus constituting a pivot portion 52.

The pivot portion 52 is located corresponding the universal coupling 22 of the steering shaft 11 so that its central axis passes through the center of rocking motion of the coupling 22 (e.g., center of the universal ball 25). By doing this, the tube member 40 and the steering shaft 11 therein can tilt back and forth around the pivot portion 52 with respect to the housing 30. The tilt angle of the steering shaft 11 can be changed by means of the pivot portion 52 and coupling 22.

A buzzer mounting portion 55 is formed integrally with the tube body portion 51 on the front part of the tube member 40. A buzzer 56 (shown in FIG. 1) can be fitted and held in the mounting portion 55. The buzzer 56 is designed to buzz depending on the engine state and the like.

An assistant spring 58 is provided between the underside of the tube member 40 and the bottom wall of the housing 30. The spring 58 produces an urging force that causes the steering shaft 11 to rock upward from a neutral position N to an up position, resisting its own weight and the like.

A gear portion 60 is formed integrally with the tube body portion 51, on the rear part of the tube member 40 near the driver. The gear portion 60 has a plurality of teeth 61 that are arranged vertically along a circular arc Q around a center 52*a* of the pivot portion 52.

The housing 30 is provided with a locking member 70. The member 70 is formed having a fitting portion 71 on its end portion that faces the gear portion 60. The fitting portion 71 has a tooth configuration such that it can engage those teeth 61 of the gear portion 60 which are situated corresponding to the inclination of the tube member 40 (i.e., tilt angle of the steering shaft 11).

The locking member 70 is supported on the housing 30 by means of a horizontal rocking shaft 72 so as to be rockable back and forth. The member 70 can move between a locking position in which the fitting portion 71 engages the gear portion 60 and an unlocking position in which the fitting portion 71 is disengaged from the gear portion 60.

An operating member 80 is located on the rear part of the housing 30 beside the driver. The member 80 is vertically movable along a vertical guide portion 81 that is attached to the housing 30. A handgrip portion 83 is formed on the upper part of an operating member body 82. The handgrip portion is a recess having a shape such that the driver can insert his fingers therein.

A horizontally extending cylindrical retaining portion 85 is formed integrally with the operating member body 82 at the lower part of the operating member 80. As shown in the enlarged view of FIG. 5, the retaining portion 85 is inserted in a cam groove 90 that is formed in the lower part of the locking member 70. The groove 90 includes first and second cam surfaces 91 and 92, front and rear, which are situated on the position remoter from the rocking shaft 72, and third and fourth cam surfaces 93 and 94, which are situated on the position nearer to the shaft 72. As mentioned later, the retaining portion 85 is movable over the cam surfaces 91 to 94.

Figure 5:
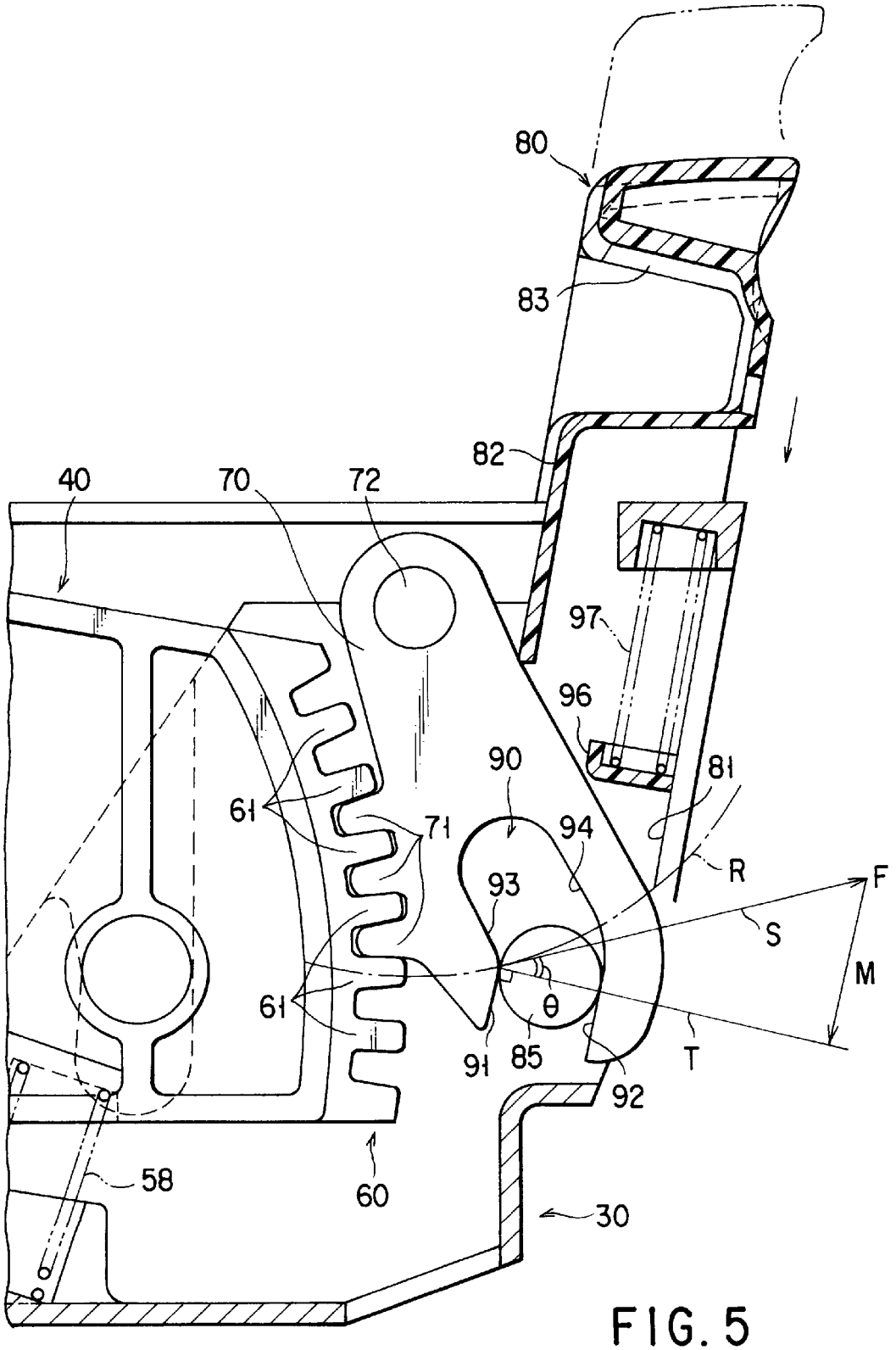
FIG. 5 is a partially enlarged sectional view of the steering handle apparatus.
Figure 6:
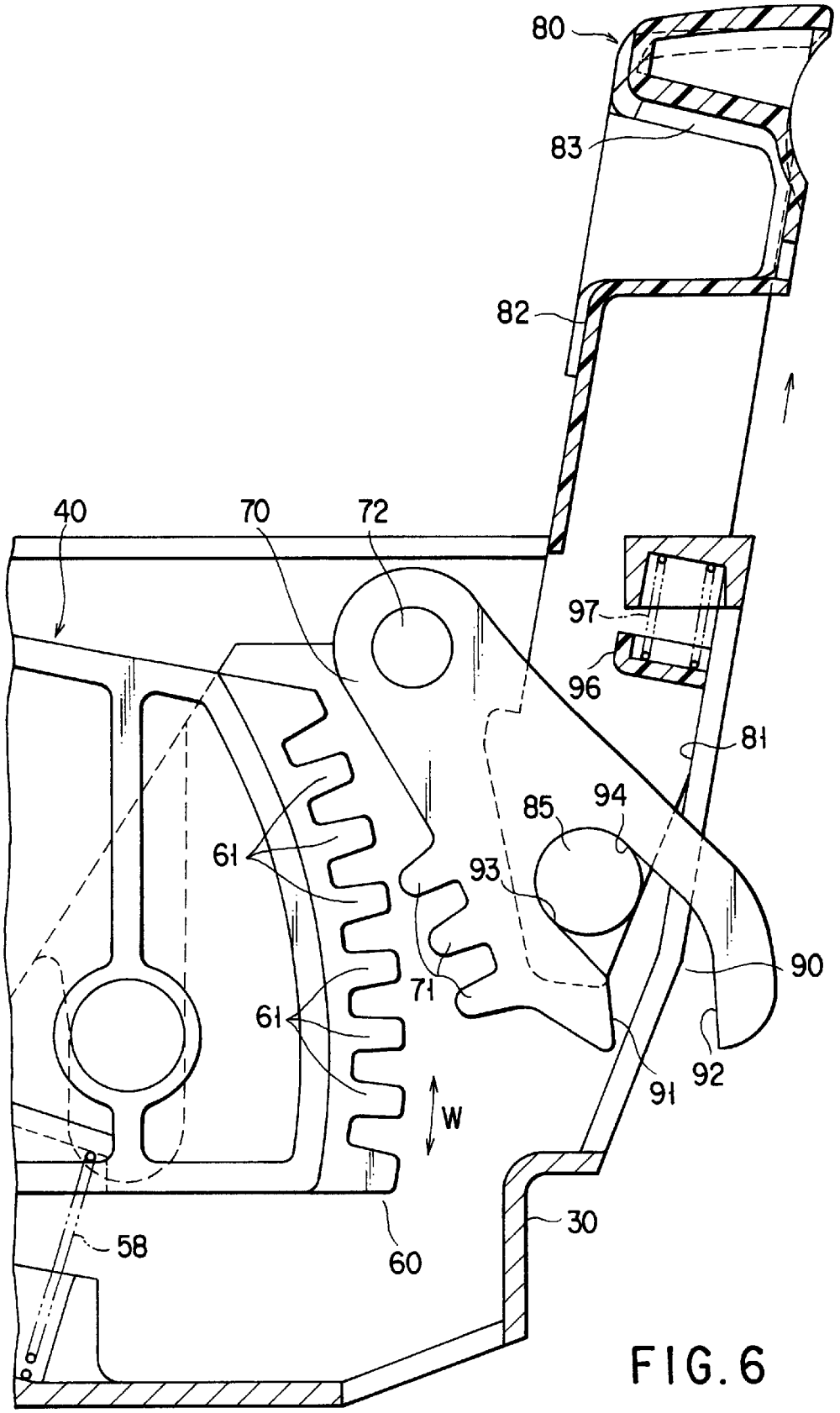
FIG. 6 is a sectional view showing an operating member of the steering handle apparatus in its up position.

As shown in FIG. 5, a segment T that extends at right angles to the first cam surface 91 is inclined downward at an angle θ to a tangent S to a circular arc R around the rocking shaft 72. Thus, when the operating member 80 is moved to its down position, the fitting portion 71 of the locking member 70 is pushed toward the gear portion 60 by the retaining portion 85. When the operating member 80 is moved upward, as shown in FIG. 6, the fitting portion 71 of the locking member 70 is pushed away from the teeth 61 of the gear portion 60 by the retaining portion 85. A push spring 97 for urging the operating member 80 toward the down position is located between the member 80 and a spring shoe portion 96 that is attached to the housing 30.

The following is a description of the operation of the steering handle apparatus 10.

When the operating member 80 is in the down position, as shown in FIG. 5, its retaining portion 85 is situated between the first and second cam surfaces 91 and 92 of the locking member 70. Accordingly, the fitting portion 71 of the locking member 70 is pushed toward the gear portion 60. As this is done, the fitting portion 71 engages the teeth 61 of the gear portion 60.

If a heavy longitudinal load, for example, is applied to the steering shaft 11 in the aforesaid locked state (FIG. 5) so that a power input F acts in the direction to disengage the gear portion 60 and the fitting portion 71 from each other, the first cam surface 91 pushes the retaining portion 85. As this is done, a moment M in the direction to lower the operating member 80 is generated according to the angle θ of the first cam surface 91. Since the cam surface 91 is not expected to produce any force to lift up the member 80, its angle θ should only be 0° to more.

The operating member 80 is urged by the cam surface 91 toward the down position in which the locking member 70 and the gear portion 60 are kept in engagement with each other. The higher the power input F, the greater the moment M is. Thus, the engagement between the fitting portion 71 and the gear portion 60 can be maintained very securely.

The tilt angle of the steering shaft 11 can be changed by manually pulling up the operating member 80 to its up position, as shown in FIG. 6. By doing this, the retaining portion 85 of the operating member 80 is moved to the space between the third and fourth cam surfaces 93 and 94 of the locking member 70. Since the fitting portion 71 of the member 70 moves away from the teeth 61 of the gear portion 60, moreover, it is disengaged from the teeth 61. Therefore, the tube member 40 is allowed to rock back and forth around the pivot portion 52. In consequence, the upper shaft portion 20 of the steering shaft 11 above the universal coupling 22 can rock in the same direction as the tube member 40.

When the steering shaft 11 is unlocked (FIG. 6), it is pushed up toward the Up position by the urging force of the assistant spring 58, resisting its own weight and the weights of its accessories. Thus, the tilt angle can be adjusted with a light force, and the shaft 11 can be prevented from suddenly rocking downward the moment it is unlocked.

As the upper shaft portion 20 of the steering shaft 11 is adjusted to a desired tilt angle in the aforesaid unlocked state, the tube member 40 moves in the direction indicated by arrow W in FIG. 6. If the operating member 80 is lowered after the tilt angle adjustment, its retaining portion 85 moves to the space between the first and second cam surfaces 91 and 92 of the locking member 70 again. As this is done, the fitting portion 71 of the locking member 70 is pushed toward the gear portion 60, so that it engages those teeth 61 of the gear portion 60 which are situated corresponding to the adjusted tilt angle. In this state, the operating member 80 is held in the down position (locked state) by the retaining member 85 and the first cam surface 91.

When the operating member 80 is returned to the down position, the fitting portion 71 sometimes cannot engage the teeth 61 due to dislocation. In this case, the fitting portion 71 can be caused to engage the teeth 61 by means of the urging force of the push spring 97 when the fitting portion 71 is situated corresponding to the teeth 61 if the steering shaft 11 is slightly moved in the tilt angle direction.

The lower shaft portion 21 of the steering shaft 11 according to the present embodiment can always be kept at a fixed tile angle without regard to the tilt angle of the upper shaft portion 20. Thus, the trace of rocking motion of the arm 14 during the handle operation and the trace of movement of the steering cable 16 always pass through a fixed plane.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A steering handle apparatus for a watercraft, which is provided with a steering shaft having a handlebar mounting section at the upper part thereof and an arm at the lower part connected with a steering cable, comprising:

a housing attached to the body of the watercraft and including supporting means on either side thereof;

a tube member including a pivot portion supported on the housing by the supporting means, having a guide hole through which the steering shaft is passed, capable of tilting back and forth around the pivot portion, and including a gear portion formed of a plurality of teeth arranged along a circular arc around the pivot portion;

a locking member attached to the housing and including a fitting portion movable between a locking position in which the fitting portion engages those teeth of the gear portion which are situated corresponding to the tilt angle of the tube member and an unlocking position in which the fitting portion is disengaged from the gear portion; and an operating member including a retaining portion capable of engaging the locking member, the operating member being operable between a down position in which the locking member is moved to the locking position and an up position in which the locking member is moved to the unlocking position.

2. A steering handle apparatus according to claim 1, wherein said steering shaft includes an upper shaft portion on the upper side, a lower shaft portion on the lower side, and a universal coupling connecting the upper and lower shaft portions for relative tilting motion and situated corresponding to the pivot portion.

3. A steering handle apparatus according to claim 1, wherein said locking member includes a cam surface adapted to urge the retaining portion of the operating member toward the down position or to produce no force to push up the operating member when power input is applied in the direction to disengage the fitting portion from the gear portion.

4. A steering handle apparatus according to claim 1, further comprising a push spring located between the operating member and the housing and urging the operating member toward the down position.

5. A steering handle apparatus according to claim 1, further comprising an assistant spring located between the housing and the tube member and capable of producing an urging force to cause the steering shaft to rock up toward a neutral position or an up position.

* * * * *